US008584641B2

(12) United States Patent
Shewell

(10) Patent No.: US 8,584,641 B2
(45) Date of Patent: Nov. 19, 2013

(54) DEACTIVATING CAM SYSTEM FOR A VALVE TRAIN OF AN INTERNAL COMBUSTION ENGINE

(75) Inventor: Jeffrey Shewell, Clawson, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 640 days.

(21) Appl. No.: 12/817,560

(22) Filed: Jun. 17, 2010

(65) Prior Publication Data

US 2010/0319640 A1 Dec. 23, 2010

Related U.S. Application Data

(60) Provisional application No. 61/187,802, filed on Jun. 17, 2009.

(51) Int. Cl.
*F01L 1/04* (2006.01)

(52) U.S. Cl.
USPC ..... 123/90.6; 123/90.16; 29/888.1

(58) Field of Classification Search
USPC ..... 123/90.6, 90.16; 29/888.1
See application file for complete search history.

(56) References Cited

U.S. PATENT DOCUMENTS 5,239,885 A 8/1993 Voigt
5,307,768 A * 5/1994 Beier et al. ..... 123/90.17
7,980,217 B2 * 7/2011 Evans et al. ..... 123/90.6

* cited by examiner

*Primary Examiner* — Ching Chang
(74) *Attorney, Agent, or Firm* — Volpe and Koenig, P.C.

(57) ABSTRACT

A deactivating cam system (1) for a valve train (1*a*) of an internal combustion engine is provided having a camshaft (2) on which at least one cam (3) is seated for rotation but fixed in axial direction while being able to be connected through a coupling device (4) rotationally fast to the camshaft (2). The coupling device (4) has a ball detent mechanism (5) which is arranged within the cam (3) and whose balls (6) are seated within radial pockets (7) of the cam (3).

10 Claims, 4 Drawing Sheets

DEACTIVATING CAM SYSTEM FOR A VALVE TRAIN OF AN INTERNAL COMBUSTION ENGINE

CROSS-REFERENCE TO RELATED APPLICATIONS

This application claims the benefit of U.S. Provisional Application No. 61/187,802, filed Jun. 17, 2009, which is incorporated herein by reference as if fully set forth.

BACKGROUND

The invention concerns a deactivating cam system for a valve train of an internal combustion engine, said cam system comprising a camshaft on which at least one cam is seated for rotation but fixed in axial direction while being able to be connected rotationally fast to the camshaft connected through a coupling device.

A factor of increasing importance in the designing and implementation of a variable valve train in an automotive vehicle is the design space requirement of the switchable valve train components because the design space in modern engines, typically comprising four valves per cylinder, is restricted. The design space problems are further aggravated through the increasing use of direct fuel injection systems. Another requirement is that the gear shifting forces for adjusting the valve train and for actuating the gas exchange valves must be as low as possible, so that wear in the valve train is kept to a low level. A shifting of the gear shifting function to the camshaft has proved to be a favorable solution.

U.S. Pat. No. 5,239,885 discloses a deactivating cam system in which a coupling device optionally enables a rotationally fast connection to be made or to be released between a camshaft and a cam arranged axially fixed thereon. The coupling device comprises a coupling pin which extends in a radial bore of the camshaft while being loaded by a compression spring, said coupling pin being supported through spring force in radial direction in a recess within the cam, so that the cam is coupled rotationally fast. The coupling pin is seated positively engaged in a conical seating region configured in the recess. Continuing from the coupling recess is configured a pressure chamber which can be pressurized with hydraulic medium through an axial pressure medium supply of the camshaft and through a connecting channel.

For uncoupling the cam, the pressure chamber is flooded with hydraulic medium, so that the increasing pressure acts in opposition to the spring force with the result that the coupling pin is pressed back out of the recess into the camshaft bore till relative movements between the camshaft and the cam are enabled which begin when the cam lobe reaches the associated cam follower in the course of the camshaft rotation. The cam follower is thus not loaded by an adjusting force, so that, as a result of this, the corresponding gas exchange valve remains closed.

Because the seating surfaces of the coupling pin and the recess absorb, during locking, the actuating forces and, in the coupled position, all the relative forces produced between the cam and the camshaft, the coupling device is relatively prone to wear and also exhibits large tolerances. A durable, unproblematic functioning can only be achieved with high manufacturing costs.

SUMMARY

The object of the invention is therefore to provide a cam system of the above-noted type in which the aforesaid drawbacks are eliminated.

The invention achieves the above object by the fact that the coupling device comprises a ball or roller detent mechanism which is arranged within the cam and whose balls/rollers are seated within radial pockets of the cam.

In this way, a deactivating cam system comprising a coupling device is obtained in which the aforesaid drawbacks are eliminated.

The detent mechanism requires only a small design space. It is noted at the same time that supportable loads prevail in the ball or roller contact region in case of coupling, so that wear is kept within limits. Besides this, the system exhibits only a slight amount of lash. No significant increase of lash is to be expected even after a longer period of operation. The costs of manufacturing and assembly are likewise kept within reasonable bounds. Moreover, it is also possible, at least partially, to have recourse to mass-produced parts that already exist and to use production methods such as deep drawing.

The person skilled in the art will choose the appropriate number of balls or rollers with their associated detent recesses on the camshaft, depending on the load conditions in each case. If balls are used in the detent mechanism, it can be expected that, compared to rollers, the balls reach their defined final position more rapidly upon triggering of a displacement command. A use of rollers or cylinders, in contrast, has the advantage that, in this case, relatively low contact stresses are to be expected.

According to a further development of the invention, the radial pockets with associated detent recesses are distributed peripherally on the camshaft such that not all of them are equally spaced from each other. In this way, a defined angular position for "capturing" the cam on the camshaft is assured. According to an alternative proposition, it is also possible to arrange balls or rollers of different sizes with associated radial pockets equally spaced from each other in peripheral direction.

As an adjusting means for the balls or rollers a bushing is provided concentrically surrounding the camshaft, with the bushing comprising on an inner edge projecting fingers/tabs which, for realizing coupling, are displaced into matching detent recesses of the cam, so that the balls are forced radially inward partially into their detent recesses on the outer peripheral surface of the camshaft.

According to a further aspect of the invention, a bore of the cam is configured with three steps. A first step extends directly on the outer peripheral surface of the camshaft. An enlarged, second step of the bore axially adjoining the first step, receives a second outer peripheral section of the displacing element comprising the fingers. In a third bore step whose diameter is in turn larger than that of the second bore step, guidance for the displacing element is realized through its first outer peripheral section.

A further feature of the invention concerns simple measures for supplying hydraulic medium to a pressure chamber axially in front of a collar of the displacing element. It is proposed to route hydraulic medium out of a longitudinal bore of the camshaft from which at least one radial channel branches off to the outer peripheral surface of the camshaft and communicates with an annular groove tap of the first bore section of the cam, from which annular groove tap the hydraulic medium can be conveyed directly into the pressure chamber through one or more supply passages in the cam. If appropriate or necessary, a displacement of the displacing element through hydraulic medium pressure in both directions is both conceivable and intended. However, in such a case, two hydraulically separated channel systems must be provided.

The fingers of the displacing element are disengaged from the radial pockets (uncoupled position) hydraulically, their engaged position being realized through the force of a compression spring means supported on the collar. Alternatively, it is also proposed to realize the uncoupled position of the displacing element through compression spring force and the coupled position, through hydraulic medium pressure. A feasible spring is, for example, at least one coil compression spring or a coil compression spring assembly.

As a stop for one end of the coil compression spring turned away from the collar, it is proposed to use a separate disk which is retained axially outward through a securing ring for bores and extends in an annular groove of the third bore section of the cam. However, it is also conceivable to use a stop in the form of a collar or the like extending radially inward integrally from the third bore section.

According to still another proposition of the invention, the displacing element is configured as a thin-walled sheet metal bushing which is manufactured substantially, for instance, by deep drawing or by a stamping method.

Finally, the invention also provides a simple axial fixing of the cam on the camshaft, namely, by retaining the cam in both axial directions through two securing rings extending in respective annular grooves. It is understood that the cam may also comprise an integral, protruding radial flange, so that it is retained only in the other axial direction by a securing ring.

BRIEF DESCRIPTION OF THE DRAWINGS

The invention will now be described more closely with reference to the appended drawing. The figures show.

DETAILED DESCRIPTION OF THE PREFERRED EMBODIMENTS

Figure 7:
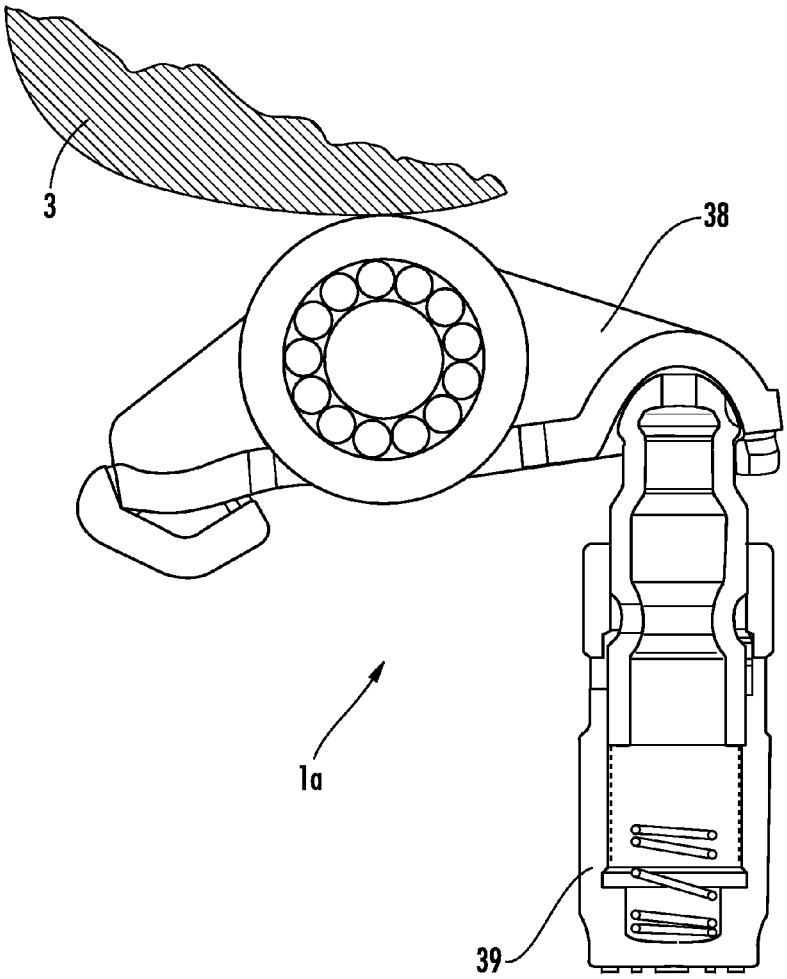

The figures show a deactivating cam system 1 (see particularly FIGS. 1 and 2) for a valve train 1*a* of an internal combustion engine such as schematically shown in FIG. 7. This figure discloses a finger lever 38 that is seated at one end for pivoting on a support element 39 and acts in lift direction at another end on a gas exchange valve, not shown. The finger lever 38 is loaded in the region of its center by a cam 3 of the cam system 1 to be described more closely in the following. It is understood that the aforesaid finger lever valve train is only an example of a valve train of an internal combustion engine. Conceivable are also all other types of valve train systems comprising an overhead or a bottom camshaft.

The cam system 1 comprises a camshaft 2 on which a cam 3 is seated for rotation while being axially fixed. A coupling device 4 through which the cam 3 can be optionally fixed rotationally fast to the camshaft 2 is installed in the cam 3.

For realizing a rotationally fixed connection of the cam 3 to the camshaft 2, the invention provides a ball detent mechanism 5. For this purpose, the cam 3 comprises peripherally distributed radial pockets 7 that are arranged in a first bore section 9 of the cam 3 which extends directly on an outer peripheral surface 8 of the camshaft 2. In each of the radial pockets 7 is seated a ball 6 serving as a detent body. In case of coupling, to be described more closely below, the balls 6 engage into complementary detent recesses 12 on the outer peripheral surface 8 of the camshaft 2.

Figure 3:
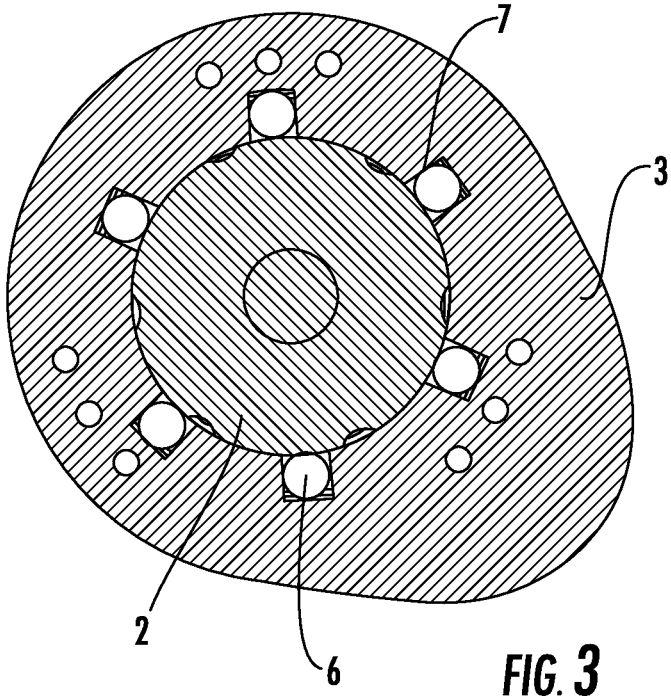
Figure 4:
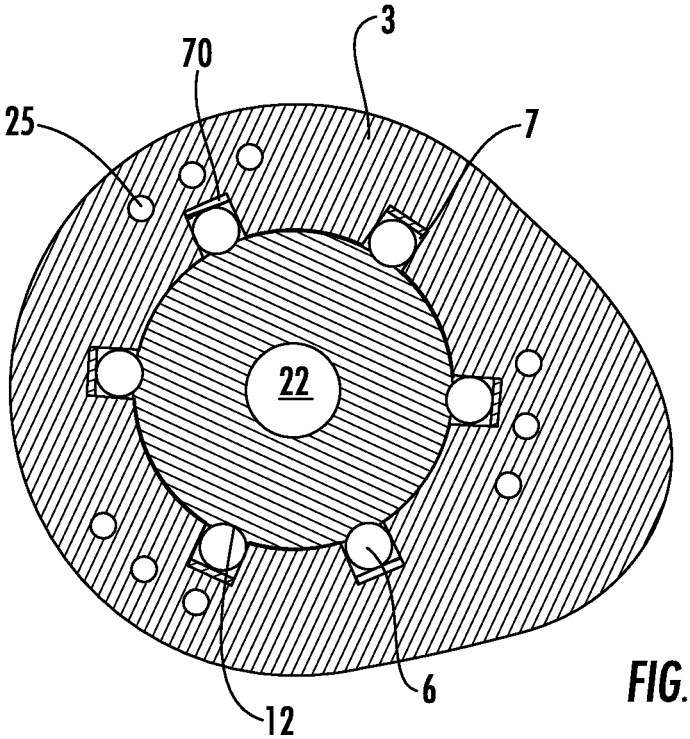
Figure 5:
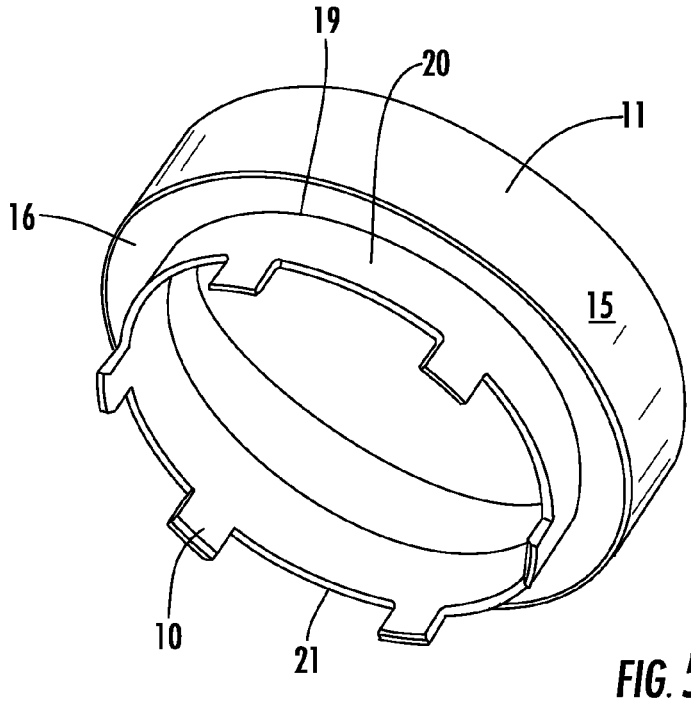
Figure 6:
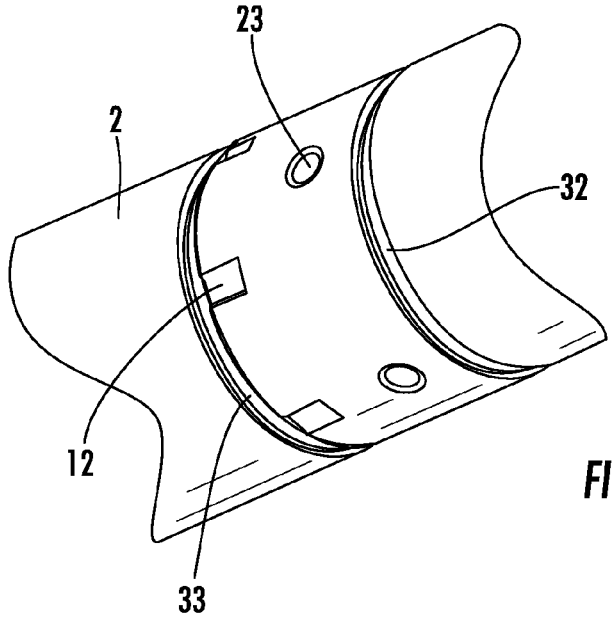

As can be seen in FIGS. 3, 4, not all of the radial pockets 7 with detent recesses 12 are uniformly spaced in peripheral direction. In this way, it is assured that the cam 3 can be locked on the camshaft 2 during operation only in a defined angular position relative to the camshaft.

Adjoining the first bore section 9 of the cam 3 is a second bore section 13 which surrounds the camshaft 2 at a distance. The second bore section 13 merges into a third bore section 14 which has a larger diameter than the second bore section 13. A displacing element 11 configured as a thin-walled sheet metal bushing and arranged within the third bore section 14 bears through a first outer peripheral section 15 against the third bore section 14. As viewed axially in direction of the first bore section 9, the displacing element 11 merges into a radially inwardly directed collar 16 from whose first inner edge 19, a second outer peripheral section 20 projects. This second outer peripheral section 20 bears against the second bore section 13 of the cam 3, and crown-like fingers 10 project from its second inner edge 21 for a displacing engagement into the radial pockets 7 of the cam 3.

In the transition region from the second to the third bore section 13, 14, a pressure chamber 18 for hydraulic medium is formed between a second annular axial end 17 of the cam 3 and the opposing collar 16 of the displacing element 11. The hydraulic medium is supplied through a longitudinal bore 22 in the camshaft 2. A plurality of radial channels 23 branch off for each cam 3 from the longitudinal bore 22. These radial channels 23 are in fluid communication with an annular groove tap 24 in the first bore section 9 of the cam 3. From there, the hydraulic medium is routed via a plurality of feed passages 25 in the cam 2 directly into the pressure chamber 18.

In this way, a displacement of the displacing element 11 into its uncoupled position is realized through hydraulic medium pressure. When the hydraulic medium pressure is turned off or strongly reduced, a spring 26, configured, in the present case, as a coil compression spring and concentrically surrounding the camshaft 2, comes into play. The spring 26 is supported with one end on an outer side 27 of the collar 16 of the displacing element 11. With its other end, the spring 26 acts against a stop 28 constituted by a disk 29 that is retained axially outward through a securing element 30 such as a securing ring seated in an annular groove 31 of the third bore section 14 of the cam 3.

In the axial direction, the cam 3 is secured on the camshaft 2 through two securing rings 34, 35. The cam 3 abuts with its one outer axial end 36 against the securing ring 34 which is seated in an annular groove 32 in the outer peripheral surface 8 of the camshaft 2. The cam 3 bears with a first annular axial end 37, situated between its first and second bore sections 13, 14, against the securing ring 35 which extends axially at the level of the second bore section 13 while being retained in an annular groove 33 in the outer peripheral surface 8 of the camshaft 2.

Figure 1:
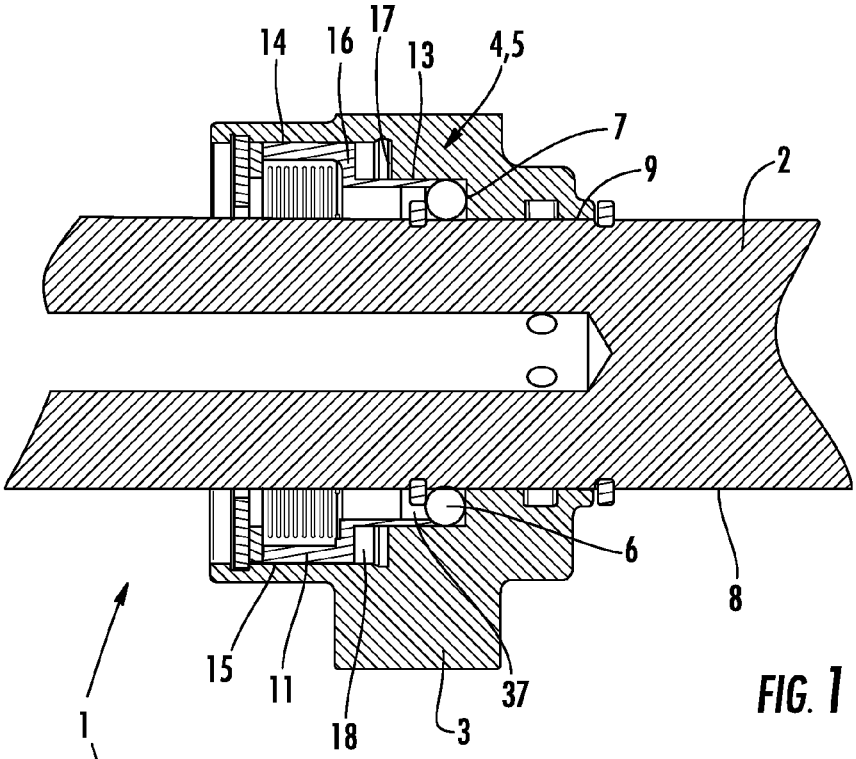
FIG. 1, a longitudinal section through a deactivating cam system, in the uncoupled state, FIG. 2, the system of FIG. 1, but in the coupled state, FIG. 3, a cross-section through a cam of the cam system in the region of its coupling device, in the uncoupled state, FIG. 4, a cross-section of FIG. 3, but in the coupled state, FIG. 5, a three-dimensional representation of a displacing element, FIG. 6, a three-dimensional view on the camshaft, showing detent recesses and axial channels, and FIG. 7, a schematic view of a valve train (here, by way of example, a finger lever valve train) loaded by the cam system.
Figure 2:
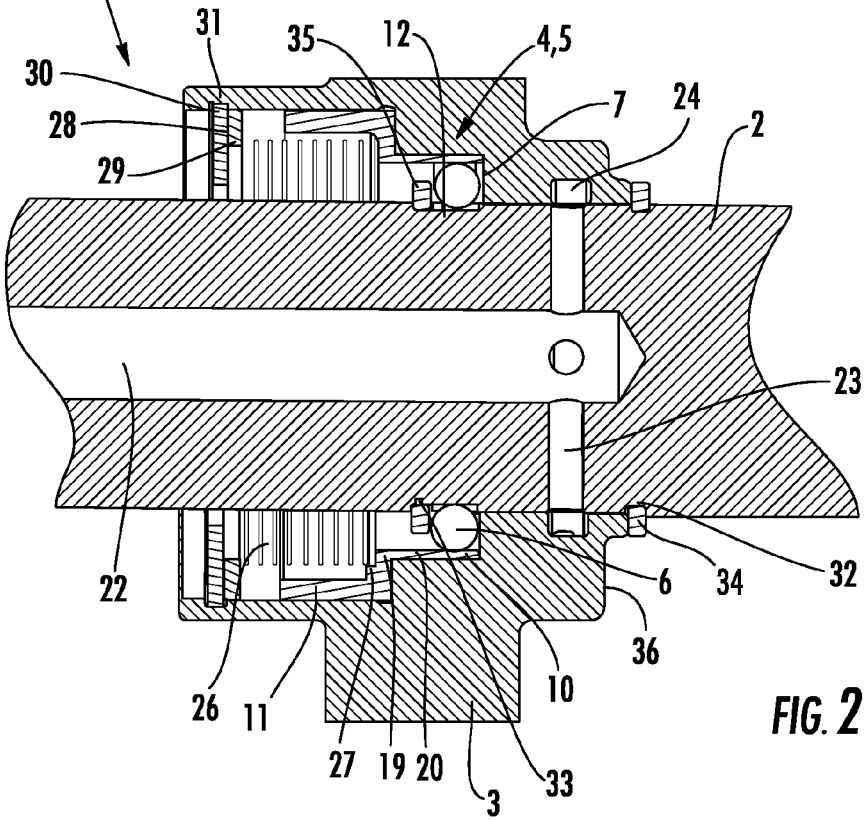

FIGS. 1, 3 disclose the uncoupled state of the cam system 1 in which the camshaft 2 races freely under the cam 3. This racing movement occurs directly at the beginning of a cam lift flank of the cam 3. During this phase, the displacing element 11 is displaced, in the present case from the right to the left, by the hydraulic medium routed into the pressure chamber 18, so that the fingers 10 of the displacing element 11 are disengaged from the radial pockets 7 and, at the beginning of the cam lift flank of the cam 3, the balls 6 are pressed out of their detent recesses 12 on the camshaft 2 and displaced completely back into their radial pockets 7. The gas exchange valve concerned thus remains closed.

For activating the cam system 1, the hydraulic medium pressure in the pressure chamber 18 is drastically reduced, so that the spring 26 loads the displacing element 11, in the present case, from the left to the right. As soon as the camshaft 2 reaches its defined angular position relative to the cam 3, the displacing element 11 "snaps" through its fingers 10 into the radial pockets 7 radially above the balls 6, so that the balls 6 are displaced radially inward partially into their appropriately confronting detent recesses 12 (configured here as semi-spherical cavities). In this way, a positive-engagement connection of the cam 3 to the camshaft 2 is established. The cam 3 loads a next cam follower such as the finger lever 38 shown in FIG. 7. The corresponding gas exchange valve opens.

LIST OF REFERENCE NUMERALS

1 Cam system
1*a* Valve train
2 Camshaft
3 Cam
4 Coupling device
5 Ball detent mechanism, detent mechanism
6 Balls
7 Radial pocket
8 Outer peripheral surface
9 First bore section
10 Fingers
11 Displacing element
12 Detent recess
13 Second bore section
14 Third bore section
15 First outer peripheral section
16 Collar
17 Second annular axial end
18 Pressure chamber
19 First inner edge
20 Second outer peripheral section
21 Inner edge
22 Longitudinal bore
23 Radial channel
24 Annular groove tap
25 Supply passage
26 Spring means
27 Outer side
28 Stop
29 Disk
30 Securing element
31 Annular groove
32 Annular groove
33 Annular groove
34 Securing ring
35 Securing ring
36 Outer axial end of cam
37 First annular axial end
38 Finger lever
39 Support element

The invention claimed is:

1. A deactivating cam system for a valve train of an internal combustion engine, comprising a camshaft on which at least one cam is seated for 360° rotation, fixed in an axial direction and able to be connected rotationally fast to the camshaft through a coupling device, the coupling device comprises a ball or roller detent mechanism which is arranged within the cam and having at least one of balls or rollers that can rotate 360° around the camshaft with the cam and are seated within radial pockets in the cam.

2. A deactivating cam system for a valve train of an internal combustion engine, comprising a camshaft on which at least one cam is seated for rotation, fixed in an axial direction and able to be connected rotationally fast to the camshaft through a coupling device, the coupling device comprises a ball or roller detent mechanism which is arranged within the cam and having at least one of balls or rollers that are seated within radial pockets in the cam, wherein the radial pockets are disposed peripherally spaced in a first bore section of the cam extending directly on an outer peripheral surface of the camshaft, and for realizing a coupled state for a full valve lift, the at least one of the balls or rollers are displaced radially inward by a displacing element of the coupling device having fingers that engage radially on an outside into the radial pockets, so that the at least one of the balls or rollers are forced partially into complementary detent recesses which are matched to the at least one of the balls or rollers only in one relative angular position of the cam to the camshaft while being arranged on an outer peripheral surface of the camshaft, and for realizing an uncoupled state for a zero valve lift, the fingers of the displacing element are made to disengage from the radial pockets, so that the at least one of the balls or rollers are released from the detent recesses and displaced into the radial pockets.

3. The cam system of claim 2, wherein the radial pockets with the associated detent recesses are peripherally distributed, so that not all of the pockets are uniformly distributed, or that the radial pockets with associated detent recesses are uniformly distributed peripherally but at least one of the balls or rollers of one of the radial pockets and the associated one of the detent recesses has a size different from a size of other ones of the at least one of the balls or rollers with the associated radial pockets.

4. The cam system of claim 2, wherein a second bore section adjoins the first bore section of the cam, the second bore section is situated at a distance from the camshaft and merges into a third bore section that is situated at a greater distance from the camshaft than the second bore section, in which third bore section a first outer peripheral section a bushing forming a part of the displacing element is guided, the first outer peripheral section merges axially inside on a side of the detent mechanism into an inwardly directed collar, between the collar and a facing second annular axial end of the cam is formed a pressure chamber for hydraulic medium between the second and the third bore section, so that, upon flooding of the pressure chamber, the axial uncoupled position of the displacing element is realized, wherein a second outer peripheral section protrudes in direction of the detent mechanism from a first inner edge of the collar and is guided in the second bore section, and the fingers project axially from a second inner edge of the second outer peripheral section.

5. The cam system of claim 4, wherein the hydraulic medium in the pressure chamber can be supplied out of a longitudinal bore through the camshaft, and, starting from the longitudinal bore at a level of the first bore section of the cam, one or more radial channels for the hydraulic medium branch off toward the outer peripheral surface of the camshaft, the first bore section of the cam comprising in this region, an annular groove tap for the hydraulic medium, and the hydraulic medium can be routed from the annular groove tap into the pressure chamber through one or more supply passages in the cam.

6. The cam system of claim 4, wherein a resetting of the displacing element is realized in opposition to the hydraulic medium pressure through a force of at least one spring which acts at one end against an outer side of the collar of the displacing element and which bears at another end against a stop starting from the third bore section of the displacing element.

7. The cam system of claim 6, wherein the stop is configured as a separate disk which is retained axially outward through a ring-shaped securing element that is at least one of positioned in or snapped into an annular groove of the third bore section of the cam.

8. The cam system of claim 4, wherein the displacing element is configured as a thin-walled sheet metal bushing.

9. The cam system of claim 4, wherein the cam is retained axially on the camshaft through two securing rings extending in respective annular grooves on the outer peripheral surface of the cam, the cam bearing, on one side, with a first outer axial end on a side of the first bore section against one of the securing rings, and on another side, with a first annular axial end between the first and the second bore section against the other one of the securing rings.

10. The cam system of claim 2, wherein the displacing element is configured as a thin-walled sheet metal bushing.

* * * * *